US008272635B2

(12) United States Patent
Wakana

(10) Patent No.: US 8,272,635 B2
(45) Date of Patent: Sep. 25, 2012

(54) IMAGE FORMING APPARATUS

(75) Inventor: Takashi Wakana, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 12/588,022

(22) Filed: Oct. 1, 2009

(65) Prior Publication Data

US 2010/0084805 A1 Apr. 8, 2010

(30) Foreign Application Priority Data

Oct. 7, 2008 (JP) ..... 2008-260914

(51) Int. Cl.
*B65H 3/06* (2006.01)
*B65H 3/32* (2006.01)

(52) U.S. Cl. ..... 271/117; 271/113; 271/109

(58) Field of Classification Search ..... 271/117, 271/113, 109
See application file for complete search history.

(56) References Cited

U.S. PATENT DOCUMENTS 5,244,191 A * 9/1993 Kanekura ..... 271/10.11

FOREIGN PATENT DOCUMENTS

| | | | | |
|---|---|---|---|---|
| JP | 55-23352 | | | 2/1980 |
| JP | 58047734 | A | * | 3/1983 |
| JP | 60056735 | A | * | 4/1985 |
| JP | 02198935 | A | * | 8/1990 |
| JP | 03102032 | A | * | 4/1991 |
| JP | 04197930 | A | * | 7/1992 |
| JP | 05201609 | A | * | 8/1993 |
| JP | 2005-154053 | | | 6/2005 |
| JP | 2007-099416 | A | | 4/2007 |

* cited by examiner

*Primary Examiner* — Luis A Gonzalez
(74) *Attorney, Agent, or Firm* — Rabin & Berdo, P.C.

(57) ABSTRACT

An image forming apparatus includes a medium placing portion on which a medium is placed, a feed roller rotatably provided in contact with the medium placed on the medium placing portion so as to feed the medium, guide members disposed on both sides of the feed roller for guiding the medium being fed. The guide members are movable in a direction substantially perpendicular to a surface of the medium. A biasing unit is provided for biasing the guide members in a direction toward the medium.

18 Claims, 6 Drawing Sheets

IMAGE FORMING APPARATUS

BACKGROUND OF THE INVENTION

The present invention relates to an image forming apparatus.

A general image forming apparatus such as a printer (for example, a color printer), a copier, a facsimile machine, a combined machine or the like includes a sheet feeder portion provided inside or outside of a main body of the image forming apparatus. Sheets (i.e., media) are set in the sheet feeder portion. In the case where a plurality of sheets (i.e., a stack) are set in the sheet feeder portion, a topmost sheet is separated from other sheets by a separation mechanism, and is transported by a transport mechanism to an image forming portion in the main body of the image forming apparatus.

The conventional sheet feeder portion includes a separation mechanism with a separation pad. In such a conventional sheet feeder portion, a sheet placing plate is biased in a direction toward a feed roller so that the topmost sheet of the stack on the sheet placing plate contacts the feed roller. The feed roller brings the topmost sheet to a portion between the feed roller and the separation pad composed of a friction piece. Due to a friction between the sheet and the separation pad, the sheet is separated, and is fed in a predetermined direction. The feed roller is mounted to a roller shaft, and a rotation of a drive motor is transmitted to the feed roller via the roller shaft.

Further, a pair of guide rollers are fixed to the roller shaft on both sides of the feed roller (to be more specific, on symmetrical positions with respect to the feed roller). The guide rollers rotate together with the roller shaft, and guide the sheet at the vicinities of widthwise edges of the sheet (see, for example, Patent Document No. 1).

Patent Document No. 1: Japanese Laid-Open Patent Publication No. 2007-099416

However, in the above described sheet feeder portion, when the guide rollers guide the sheet, the sheet may be partially bent by being pressed against the guide rollers, and a reaction force may be caused by the bending of the sheet. As a result, a friction may occur between the sheet currently being fed and the next sheet, and a friction may occur between the sheet currently being fed and the feed roller. That is, a feed load (i.e., a load applied to the feed roller for feeding the sheets) may be generated.

SUMMARY OF THE INVENTION

The present invention is intended to provide an image forming apparatus capable of preventing generation of large feed load and preventing misfeed of medium.

The present invention provides an image forming apparatus including a medium placing portion on which a medium is placed, a feed roller rotatably provided in contact with the medium placed on the medium placing portion so as to feed the medium, guide members disposed on both sides of the feed roller for guiding the medium being fed. The guide members are movable in a direction substantially perpendicular to a surface of the medium. A biasing unit is provided for biasing the guide members in a direction toward the medium.

Since the guide members are movable in the direction perpendicular to the surface of the medium, and biased in the direction toward the medium, it becomes possible to prevent generation of large feed load and prevent misfeed of the medium.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Hereinafter, embodiments of the present invention will be described with reference to the attached drawings. Descriptions will be made of a printer as an example of an image forming apparatus.

Figure 1:
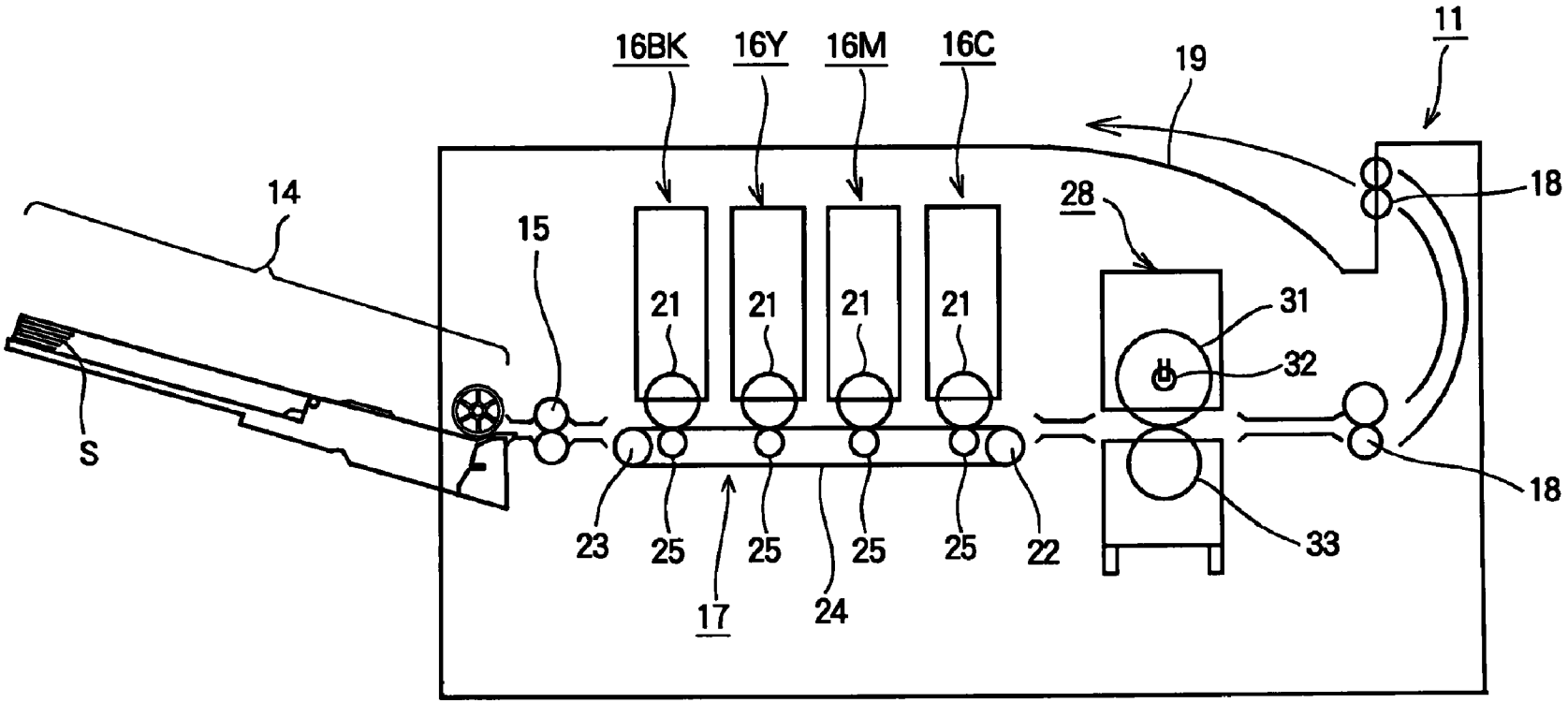
FIG. 1 is a schematic view showing a printer according to the first embodiment of the present invention.

FIG. 1 is a schematic view showing a printer (i.e., an image forming apparatus) according to the first embodiment of the present invention. In FIG. 1, the printer includes a main body 11 (i.e., an apparatus main body) and a sheet feeder portion 14 (i.e., a medium feed unit) provided so as to protrude from the main body 11. The sheet feeder portion 14 is so configured as to store a stack of a plurality of sheets S (i.e., media), and to separately feed the individual sheets S. A pair of transport rollers 15 are provided in the main body 11 and in the vicinity of the sheet feeder portion 14. The transport rollers 15 transport the sheet S (having been fed by the sheet feeder portion 14) to image forming units 16Bk, 16Y, 16M and 16C (described below) in the main body 11. The image forming units 16Bk, 16Y, 16M and 16C (i.e., developing devices) are configured form toner images (i.e., developer images) of Black, Yellow, Magenta and Cyan. A transfer unit 17 is disposed in the main body 11 so as to face the image forming units 16Bk, 16Y, 16M and 16C. The transfer unit 17 is configured to transfer the toner images of the respective colors (formed by the image forming units 16Bk, 16Y, 16M and 16C) to the sheet S to thereby form a color image on the sheet S. A fixing unit (i.e., a fixing device) is disposed on a downstream side (i.e., a right side in FIG. 1) of the image forming units 16Bk, 16Y, 16M and 16C. The fixing unit 28 is configured to fix the color image to the sheet S. Two pairs of ejection rollers 18 are disposed on the downstream side of the fixing unit 28. The ejection rollers 18 are configured to eject the sheet S (on which the color image is fixed) to the outside of the main body 11. A stacker 19 is disposed on the outside of the main body 11. The sheets S ejected by the ejection rollers 18 are stacked on the stacker 19.

Each of the image forming units 16Bk, 16Y, 16M and 16C includes a photosensitive drum 21 as an image bearing body on which a toner image is formed. The transfer unit 17 includes a driving roller (i.e., a first roller) 22, a driven roller (i.e., a second roller) 23 and a transfer belt 24 stretched around the drive and driven rollers 22 and 23. The transfer belt 24 is driven by the driving roller 22 so as to transport the sheet S. The transfer unit 17 further includes transfer rollers 25 disposed facing the respective photosensitive drums 21 of the image forming units 16Bk, 16Y, 16M and 16C. The transfer rollers 25 transfer the respective toner images from the respective photosensitive drum 21 to the sheet S.

The fixing unit 28 includes a heat roller 31, a pressure roller 33 pressed against the heat roller 31, and the like. A heat source 32 is provided inside the heat roller 31.

Figure 2:
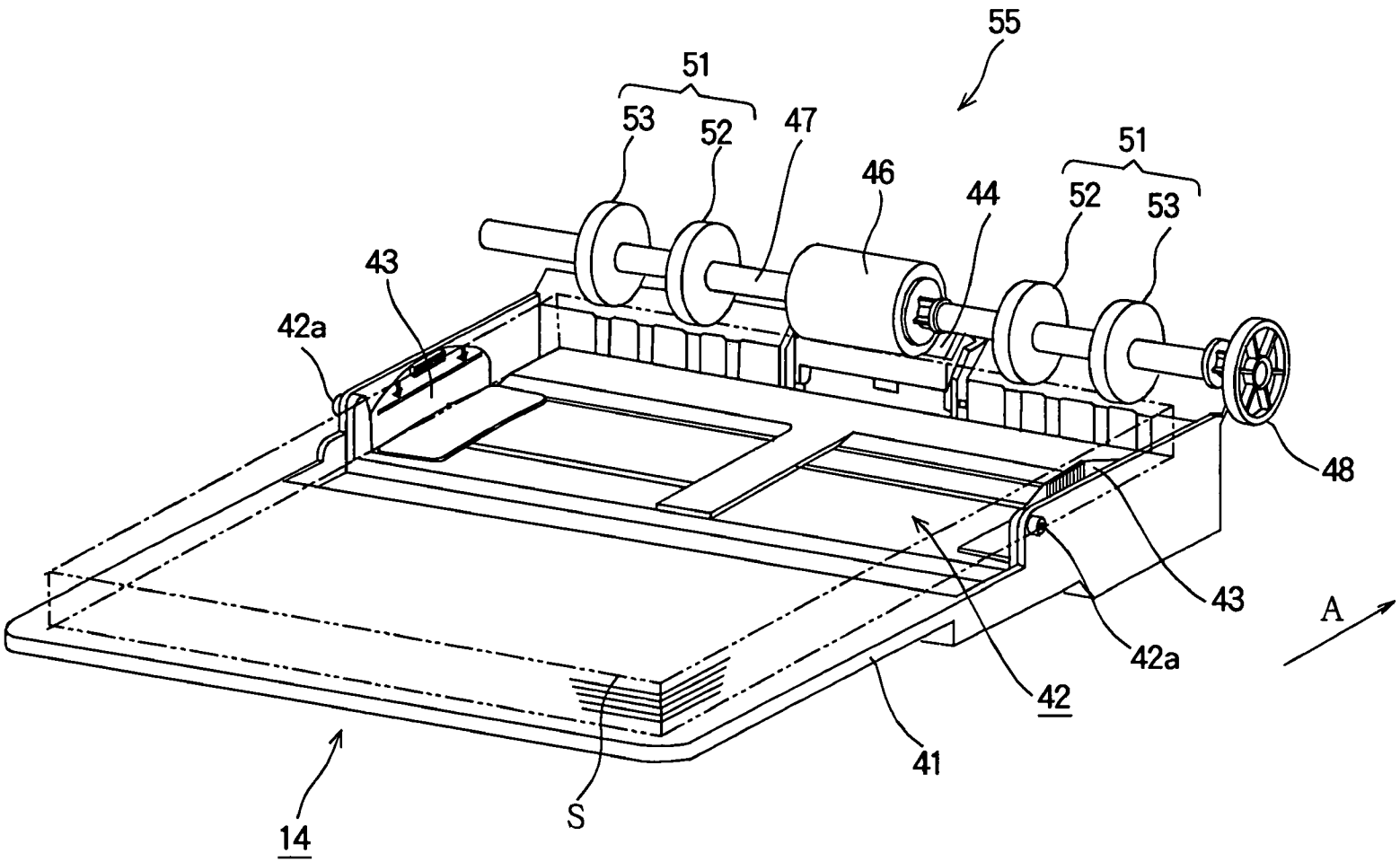
FIG. 2 is a perspective view showing a sheet feeder portion according to the first embodiment of the present invention.

FIG. 2 is a perspective view showing the sheet feeder portion 14 according to the first embodiment of the present invention.

As shown in FIG. 2, the sheet feeder portion 14 includes a feed tray 41 (i.e., a placing table or a tray portion) for placing the sheets S, and a medium placing portion 42 (or a medium placing plate) on which the sheets S are placed. The medium placing portion 42 is supported by the feed tray 41 so as to be swingable about a pair of rotation shafts 42*a* disposed on both sides of the feed tray 41 in the widthwise direction. A pair of sheet guides 43 (i.e., a medium regulating members) are provided on the medium placing portion 42. The sheet guides 43 are configured to sandwich the sheets S therebetween at predetermined positions in the widthwise direction. A separation pad 44 is disposed at a front end (i.e., a downstream end in a feeding direction A of the sheet S) of the medium placing portion 42.

A roller shaft 47 (i.e., a drive shaft) is provided on the front end of the medium placing portion 42, and is rotatably supported by the frame (not shown) of the main body 11. The roller shaft 47 extends in the widthwise direction of the medium placing portion 42. A feed roller (i.e., a medium feed member) is fixed to the roller shaft 47 at a center in the widthwise direction of the medium placing portion 42 so that the feed roller 46 is rotatable contacting the sheet S on the medium placing portion 42. The feed roller 46 is provided for feeding the sheet S to the transport rollers 15 (FIG. 1) in the main body 11. A drive gear 48 is fixed to an end of the roller shaft 47. The drive gear 48 is linked with a not shown drive motor (i.e., a driving portion) via not shown gears.

Further, a pair of guide roller units 51 are provided on the roller shaft 47. The guide roller units 51 are disposed on both sides of the feed roller 46 in axial direction of the roller shaft 47 in a symmetrical manner with respect to a center of the roller shaft 47. Each of the guide roller units 51 includes at least one guide member, and in this embodiment, includes two guide rollers (i.e., guide members) 52 and 53. The guide rollers 52 and 53 are substantially coaxial with the feed roller 46. The guide rollers 52 and 53 are movable in a direction (in this example, a vertical direction) substantially perpendicular to a surface of the sheet S, and are biased in a direction toward the surface of the sheet S (in this example, downward).

When the drive motor is driven, the rotation of the drive motor is transmitted to the feed roller 46 via the roller shaft 47, and the feed roller 46 rotates to thereby feed the sheet S in the feeding direction A toward the transport rollers 15 (FIG. 1). In this state, the guide rollers 52 and 53 rotate following the sheet S due to a friction (between the sheet S and the guide rollers 52 and 53), and guide the sheet S being fed. The above described feed roller 46, the roller shaft 47 and the guide roller units 51 constitute a feed roller unit 55.

Next, a detailed structure of the feed roller unit 55 will be described.

Figure 3:
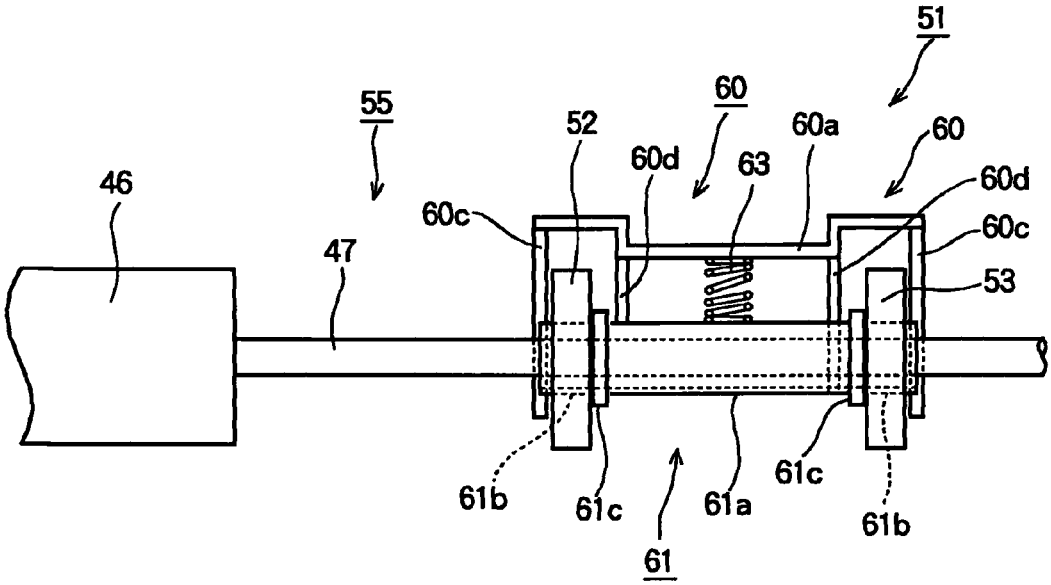
FIG. 3 is a front view showing a main part of a feed roller unit according to the first embodiment of the present invention.
Figure 4:
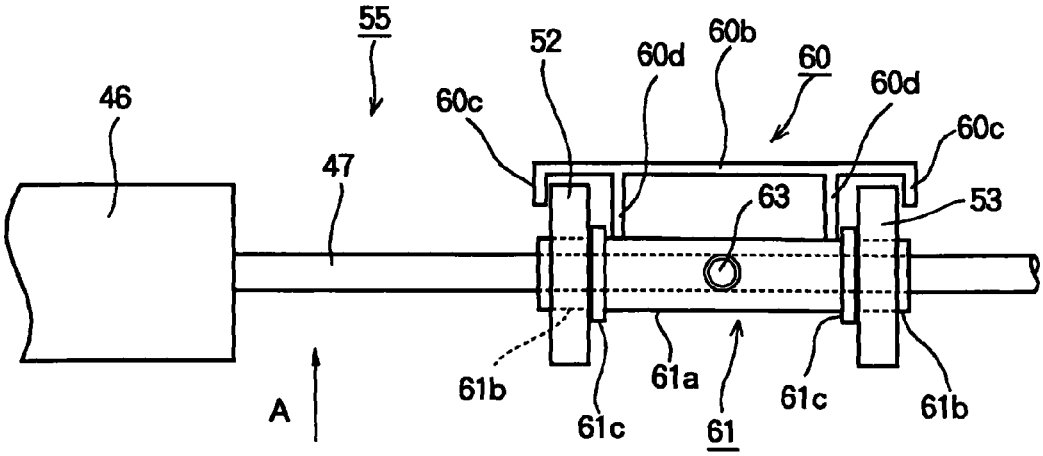
FIG. 4 is a plan view showing the main part of the feed roller unit according to the first embodiment of the present invention.
Figure 5:
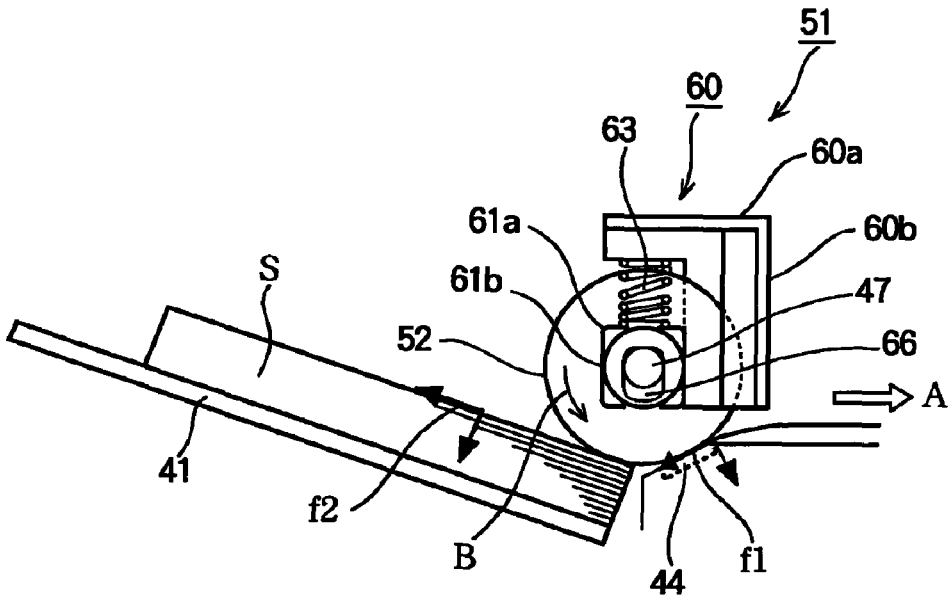
FIG. 5 is a side view for illustrating an operation of the feed roller unit according to the first embodiment of the present invention.
Figure 6:
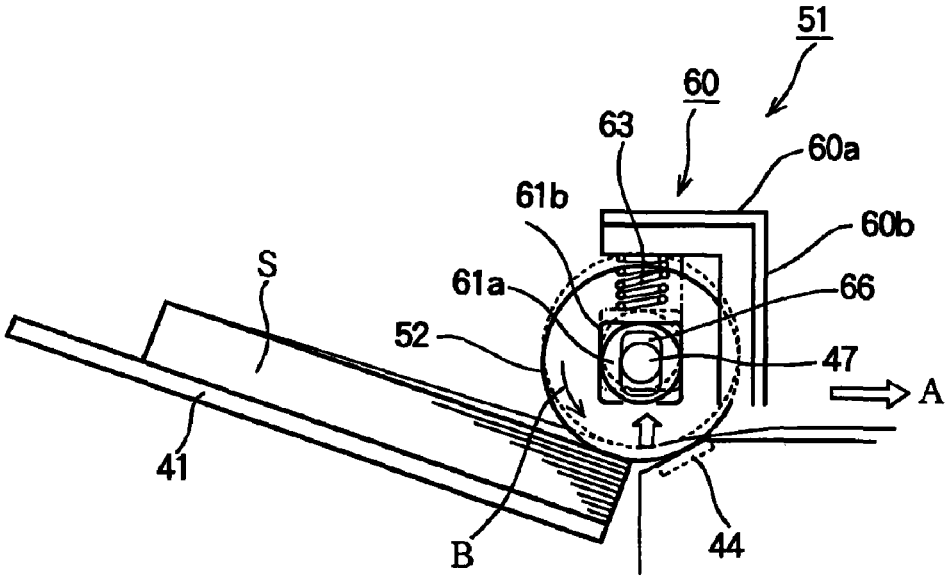
FIG. 6 is a side view for illustrating the operation of the feed roller unit according to the first embodiment of the present invention.

FIGS. 3 and 4 are a front view and a plan view showing a main part of the feed roller unit 55 according to the first embodiment of the present invention. FIGS. 5 and 6 are side views for illustrating an operation of the feed roller unit 55 according to the first embodiment of the present invention.

In FIGS. 3 through 6, a reference numeral 55 indicates the feed roller unit, a reference numeral 46 indicates the feed roller, a reference numeral 47 indicates the roller shaft and a reference numeral 51 indicates the guide roller unit as described above.

As shown in FIGS. 3 and 4, each guide roller unit 51 includes a guide portion 60 having a substantially L-shape cross section fixed to the frame (not shown) of the main body 11, a roller-shaft-receiving portion 61 mounted to the guide portion 60 so as to be movable in the vertical direction, and a spring 63 (i.e., a biasing unit) that biases the roller-shaft-receiving portion 61 downward. Further, in each guide roller unit 51, the above described guide rollers 52 and 53 are rotatably supported at both ends of the roller-shaft-receiving portion 61. The spring biases the guide rollers 52 and 53 and the roller-shaft-receiving portion 61 downward (i.e., toward the surface of the sheet S) so that a force in a range from 25 gf to 35 gf is applied to each of the guide rollers 52 and 53.

The roller-shaft-receiving portion 61 includes a main body 61*a* having a rectangular cross section, and a pair of bearing portions 61*b* having circular cross sections and protruded from both ends of the main body 61*a*. Further, a pair of flanges 61*c* are formed between the main body 61*a* and either bearing portion 61*b*, and the flanges 61*c* extend radially outward. The flanges 61*c* act as restricting members that restrict movements of the guide rollers 52 and 53 in the axial direction (in this example, toward the main body 61*a*). The bearing portions 61*b* rotatably support the guide rollers 52 and 53. In this regard, outer circumferential surfaces of the guide rollers 52 and 53 generally contact the sheet S, but do not contact other members.

As shown in FIG. 5, the guide portion 60 includes a top wall 60*a* disposed above the roller-shaft-receiving portion 61, and a front wall 60*b* disposed in front of the roller-shaft-receiving portion 61. The guide portion 60 further includes a pair of side walls 60*c* (FIGS. 3 and 4) disposed so as to face outer sides of the guide rollers 52 and 53 on both ends of the roller-shaft-receiving portion 61. The guide portion 60 further includes a pair of inner walls 60*d* disposed on inner sides of the flange portions 61*c* and extending in parallel to the side walls 60*c*. The side walls 60*c* and the inner walls 60*d* restrict the movements of the guide rollers 52 and 53 in the axial direction. The above described spring 63 is disposed between the top wall 60*a* and the roller-shaft-receiving portion 61.

The roller-shaft-receiving portion 61 has an elongated hole 66 penetrating therethrough in the axial direction. The elongated hole 66 has a cross section elongated in a direction substantially perpendicular to the surface of the sheet S (here, in the vertical direction). The roller shaft 47 penetrates through the elongated hole 66. The roller-shaft-receiving portion 61 and the guide rollers 52 and 53 are guided only in the vertical direction by the guide portion 60 and the elongated hole 66.

The guide rollers 52 and 53 have diameters which are the same as the diameter of the feed roller 46, or slightly smaller than the feed roller 46. In this example, the diameters of the guide rollers 52 and 53 are set to 26 mm, and the diameter of the feed roller 46 is set to 28 mm.

Next, an operation of the above configured feed roller unit 55 will be described.

The medium placing portion 42 (FIG. 2) is biased upward by a force of the spring (not shown) disposed between the medium placing portion 42 and the feed tray 41, and the topmost sheet S of the stack placed on the medium placing portion 42 contacts the feed roller 46. In this state, when a controller (not shown) of the printer receives a print command from a host computer (not shown) as a superior device, the controller drives the drive motor to rotate the feed roller 46 via the roller shaft 47.

As shown in FIG. 5, when the feed roller 46 rotates, several sheets S (from the top of the stack) are fed to a contact portion between the feed roller 46 and the separation pad 44 due to a friction f1 between the topmost sheet S and the feed roller 46 and a friction f2 between the topmost sheet S and the next sheet S. The friction coefficient between the separation pad 44 and the sheet S is larger than the friction coefficient between the topmost sheet S and the next sheet S, and therefore the topmost sheet S is separated from other sheets S and is fed in the feeding direction A toward the transport rollers 15 (FIG. 1) by a feed force of the feed roller 46.

Further, the roller-shaft-receiving portion 61 and the guide rollers 52 and 53 are biased downward by the force of the spring 63, and the guide rollers 52 and 53 are pressed against the topmost sheet S. Therefore, while the sheet S is fed, the guide rollers 52 and 53 are rotated in a direction B (FIG. 5) to thereby guide the sheet S.

In the main body 11 (FIG. 1), the sheet S is transported through between the image forming units 16Bk, 16Y, 16M and 16C and the transfer unit 17, and the toner images of respective colors are transferred to the sheet S, so that the color image is formed on the sheet S. Then, the sheet S is transported to the fixing unit 28, and the toner image is fixed to the sheet S. Further, the sheet S (on which the color toner image has been fixed) is transported by the ejection rollers 18, ejected out of the main body 11, and stacked on the stacker portion 19.

In the feeding process, the sheet S is partially bent by being pressed against the guide rollers 52 and 53. In this state, a reaction force may be generated due to the bending of the sheet S. Such a reaction force may cause a friction between the sheet S currently being fed and the next sheet S and a friction between the sheet S currently being fed and the sheet feeding path. As a result, a feed load may be generated.

When thin sheets (which are easily bendable) are fed, the reaction force is relatively small, and therefore the feed load is relatively small. In contrast, when stiff sheets (which are hard to bend) such as thick sheets are fed, the reaction force may be large, and therefore the feeding load may become large.

However, according to the first embodiment of the present invention, the roller-shaft-receiving portion 61 and the guide rollers 52 and 53 are movable in the vertical direction with respect to the guide portion 60. With such a configuration, when the stiff sheets S (which are hard to bend) are fed, the roller-shaft-receiving portion 61 and the guide rollers 52 and 53 can move upward (i.e., in a direction away from the sheet S) resisting the force of the spring 63, as shown in FIG. 6.

Therefore, the reaction force due to the partial bending of the sheet S can be suppressed, and the friction between the sheet S currently being fed and the next sheet S, and the friction between the sheet S currently being fed and the sheet feeding path can be suppressed. That is, generation of large feed load can be suppressed. As a result, the sheet S is prevented from slipping with respect to the feed roller 46, and it is ensured that the sheet S is fed to reach the transport rollers 15. That is, misfeed of the sheet S can be prevented.

In this regard, the roller shaft 47 is held in the elongated hole 66 of the roller-shaft-receiving portion 61 which is elongated in the vertical direction, and therefore it is ensured that the roller shaft holding portion 61 and the guide rollers 52 and 53 are vertically movable.

As described above, according to the first embodiment of the present invention, even when stiff sheets (which are hard to bend) such as thick sheets are used, the reaction force can be suppressed since the guide member (i.e., the guide rollers 52 and 53) is movable in a direction substantially perpendicular to the surface of the sheet S. As a result, the sheet S is prevented from slipping with respect to the surface of the feed roller 46. Thus, it is ensured that the sheet S is fed to the transport rollers 15 disposed on the downstream side of the feed roller 14. That is, a misfeed of the sheet S can be prevented.

Second Embodiment

Next, the second embodiment of the present invention will be described. Components having the same structures as those of the first embodiment are assigned the same reference numerals. Regarding advantages obtained by the components having the same structures as those of the first embodiment, descriptions in the first embodiment are herein incorporated.

Figure 7:
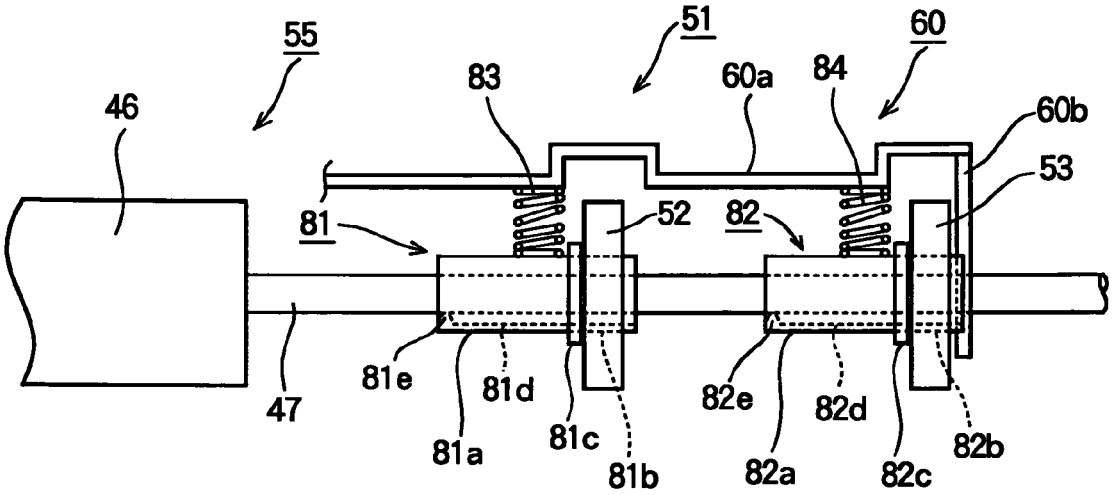
FIG. 7 is a front view showing a main part of a feed roller unit according to the second embodiment of the present invention.
Figure 8:
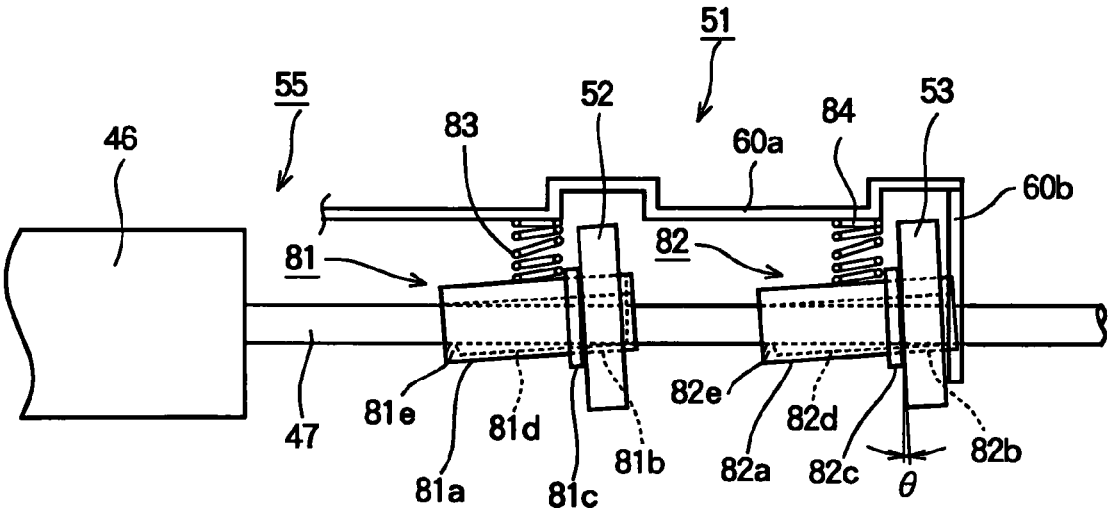
FIG. 8 is a front view for illustrating the operation of the feed roller unit according to the second embodiment of the present invention.

FIGS. 7 and 8 are front views showing a main part of a feed roller unit according to the second embodiment of the present invention.

In the second embodiment, each of the guide roller unit 51 includes a guide portion 60 having a substantially L-shape cross section fixed to the frame (not shown) of the main body 11, a plurality of (in this example, two) roller-shaft-receiving portions 81 and 82 mounted to the guide portion 60 so as to be movable in the vertical direction, and springs 83 and 84 (i.e., a biasing unit) provided for respectively biasing the roller-shaft-receiving portions 81 and 82 downward. The roller-shaft-receiving portions 81 and 82 are arranged in this order from the feed roller 46 side. The above described guide rollers 52 and 53 are respectively provided on ends of the roller-shaft-receiving portions 81 and 82 on the far side with respect to the feed roller 46. The guide rollers 52 and 53 are rotatable with respect to the roller-shaft-receiving portions 81 and 82. The springs 83 and 84 bias the guide rollers 52 and 53 and the roller-shaft-receiving portions 81 and 82 downward (i.e., toward the surface of the sheet S) so that a force in a range from 25 gf to 35 gf is applied to each of the guide rollers 52 and 53.

The roller-shaft-receiving portions 81 and 82 include main bodies 81*a* and 82*a* having rectangular cross sections, and bearing portions 81*b* and 82*b* having circular cross sections and protruded from ends of the main bodies 81*a* and 82*a* on the far side with respect to the feed roller 46. A flange 81*c* is formed between the main body 81*a* and the bearing portion 81*b*, and extends radially outward. A flange 82*c* is formed between the main body 82*a* and the bearing portion 82*c*, and extends radially outward. The flanges 81*c* and 82*c* act as restricting members that restrict movement of the guide rollers 52 and 53 in the axial direction (in this example, toward the main bodies 81*a* and 82*a*). The bearing portions 81*b* and 82*b* rotatably support the respective guide rollers 52 and 53.

The roller-shaft-receiving portions 81 and 82 have through holes 81*d* and 82*d* through which the roller shaft 47 penetrates.

In the above described first embodiment, the roller-shaft-receiving portion 61 (FIG. 5) has the elongated hole 66 having vertically elongated cross section. In contrast, in the second embodiment, each of the holes 81*d* and 82*d* of the roller-shaft-receiving portions 81 and 82 has a diameter which is larger on the far side with respect to the feed roller 46 than on the near side with respect to the feed roller 46. For this purpose, projections 81*e* and 82*e* are protruded inward from inner surfaces of ends of the holes 81*e* and 82*e* on the near side with respect to the feed roller 46. In this regard, it is also possible that each of the holes 81*d* and 82*d* has a diameter which gradually increases as a distance from the feed roller 46 increases.

When the feed roller 46 starts rotating, the sheet S is fed by the feed roller 46 and guided by the guide rollers 52 and 53. As described in the first embodiment, the sheet S is partially bent by being pressed against the guide rollers 52 and 53.

When stiff sheets (which are hard to bend) such as thick sheets are used, the reaction force may be large, and therefore a large feeding load may be generated.

However, according to the second embodiment of the present invention, the holes 81*d* and 82*d* has diameters each of which is larger on the far side with respect to the feed roller 46 than on the near side with respect to the feed roller 46. With such a configuration, when the stiff sheets S (which are hard to bend) are fed, the ends of the roller-shaft-receiving portions 81 and 82 on the near side with respect to the feed roller 46 do not move vertically (since the diameter of the holes 81*d* and 82 are small), but the ends of the roller-shaft-receiving portions 81 and 82 on the far side with respect to the feed roller 46 move upward (since the diameter of the holes 81*d* and 82 are large). As a result, the roller-shaft-receiving portions 81 and 82 are inclined at an angle θ with respect to the sheet S about the protrusions 81*e* and 82*e* resisting the forces of the springs 83 and 84 in such a manner that the bearing portions 81*b* and 82*b* (on which the guide rollers 52 and 53 are supported) move upward, as shown in FIG. 8.

Therefore, the reaction force due to the partial bending of the sheet S can be suppressed, and the friction between the sheet S currently being fed and the next sheet S and the friction between the sheet S currently being fed and the sheet feeding path can be suppressed. That is, generation of large feed load can be prevented. As a result, the sheet S is prevented from slipping with respect to the feed roller 46, and it is ensured that the sheet S is fed to the ejection rollers 18. That is, misfeed of the sheet S can be prevented.

Moreover, when the guide rollers 52 and 53 are inclined, each of the surfaces of the guide rollers 52 and 53 contacting the sheet S becomes higher on the far side with respect to the feed roller 46 than on the near side with respect to the feed roller 46. Therefore, when the guide rollers 52 and 53 feed the sheet S, the guide rollers 52 and 53 apply tension to the sheet S outward in the width direction of the sheet S. Therefore, it becomes possible to prevent generation of wrinkles on the sheet S on the downstream side of the feeding direction.

Third Embodiment

Next, the third embodiment of the present invention will be described. Components having the same structures as those of the first embodiment are assigned the same reference numerals. Regarding advantages obtained by the components having the same structures as those of the first embodiment, descriptions in the first embodiment are herein incorporated.

Figure 9:
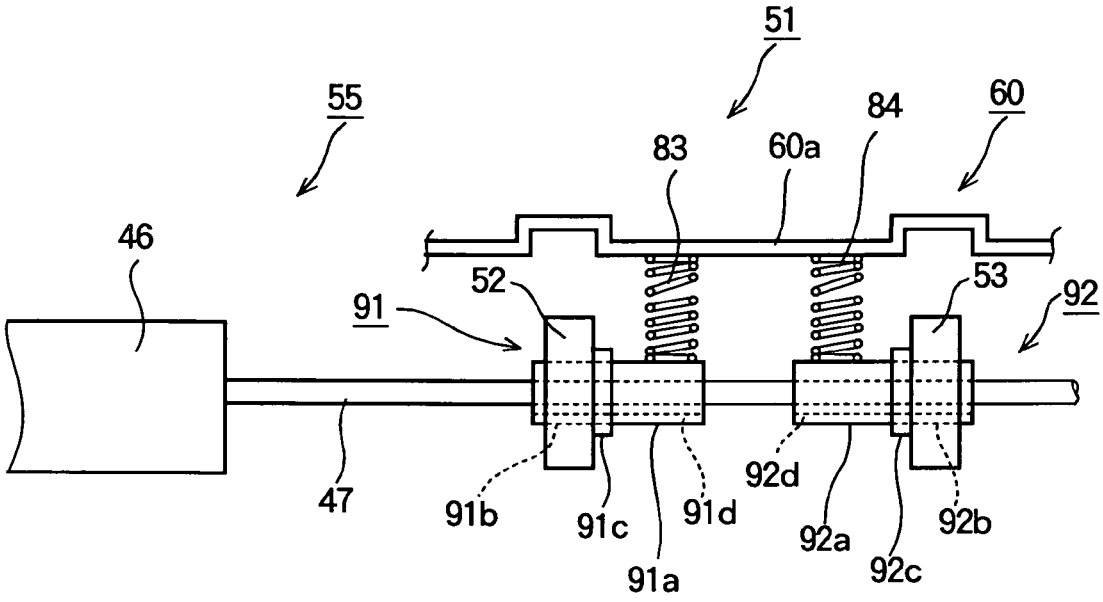
FIG. 9 is a front view showing a main part of a feed roller unit according to the third embodiment of the present invention.

FIG. 9 is a front view showing a main part of a feed roller unit according to the third embodiment of the present invention.

In the third embodiment, each of the guide roller unit 51 includes a guide portion 60 having a substantially L-shape cross section fixed to the frame (not shown) of the main body 11, a plurality of (in this example, two) roller-shaft-receiving portions 91 and 92 mounted to the guide portion 60 so as to be movable in the vertical direction, and springs 83 and 84 (i.e., biasing unit) provided for respectively biasing the roller-shaft-receiving portions 91 and 92 downward. The roller-shaft-receiving portions 91 and 92 are arranged in this order from the feed roller 46 side. The guide roller 52 is provided on an end of the roller-shaft-receiving portion 91 on the near side with respect to the feed roller 46, and the guide roller 53 is provided on an end of the roller-shaft-receiving portion 92 on the far side with respect to the feed roller 46. The guide rollers 52 and are rotatable with respect to the roller-shaft-receiving portions 91 and 92. The springs 83 and 84 bias the guide rollers 52 and 53 and the roller-shaft-receiving portions 91 and 92 downward (i.e., toward the surface of the sheet S) so that a force in a range from 25 gf to 35 gf is applied to each of the guide rollers 52 and 53.

The roller-shaft-receiving portions 91 and 92 include main bodies 91*a* and 92*a* having rectangular cross sections and bearing portions 91*b* and 92*b* having circular cross sections provided on the main bodies 91*a* and 92*a*. More specifically, the bearing portion 91*b* is protruded from an end of the main body 91*a* on the near side with respect to the feed roller 46, and the bearing portion 92*b* is protruded from an end of the main body 92*a* on the far side with respect to the feed roller 46. A flange 91*c* is formed between the main body 91*a* and the roller-shaft-receiving portion 91*b*, and extends radially outward. A flange 92*c* is formed between the main body 92*a* and the roller-shaft-receiving portion 92*c*, and extends radially outward. The flanges 91*c* and 92*c* act as restricting members that restrict movement of the guide rollers 52 and in the axial direction (in this example, toward the main bodies 91*a* and 92*a*). The bearing portions 91*b* and 92*b* rotatably support the respective guide rollers 52 and 53. The roller-shaft-receiving portions 91 and 92 have elongated holes 91*d* and 92*d* through which the roller shaft 47 penetrates. The elongated holes 91*d* and 92*d* have cross sections elongated in the direction substantially perpendicular to the surface of the sheet S (here, in the vertical direction), as the elongated hole 66 (see FIG. 5) of the first embodiment.

When the feed roller 46 starts rotating, the sheet S is fed by the feed roller 46 and guided by the guide rollers 52 and 53. As described in the first embodiment, the sheet S is partially bent by being pressed against the guide rollers 52 and 53.

When stiff sheets (which are hard to bend) such as thick sheets are fed, the reaction force may be large, and therefore a large feeding load may be generated.

However, according to the third embodiment of the present invention, the roller-shaft-receiving portions 91 and 92 and the guide rollers 52 and 53 are movable in the vertical direction with respect to the guide portion 60. With such a configuration, when the stiff sheets S (which are hard to bend) are fed, the roller-shaft-receiving portions 91 and 92 and the guide rollers 52 and 53 can move upward (i.e., in a direction away from the sheet S) resisting the forces of the springs 83 and 84. Therefore, generation of large feed load can be suppressed, and misfeed of the sheet S can be prevented.

In this regard, the roller shaft 47 is held in the elongated holes 91*d* and 92*d* of the roller-shaft-receiving portions 91 and 92 with cross sections elongated in the vertical direction, and therefore it is ensured that the roller shaft holding portions 91 and 92 and the guide rollers 52 and 53 are vertically movable.

In the above described embodiments, the roller shaft 47 is used to support the roller-shaft-receiving portions 61, 81, 82, 91, and 92. However, it is also possible to replace the roller shaft 47 with a post (as a supporting member) formed on the frame.

Further, in the above described embodiments, the printer has been described as an example of the image forming apparatus. However, the present invention is applicable to, for example, a copier, a facsimile machine, a combined machine or the like.

While the preferred embodiments of the present invention have been illustrated in detail, it should be apparent that modifications and improvements may be made to the invention without departing from the spirit and scope of the invention as described in the following claims.

What is claimed is:

1. An image forming apparatus comprising:

a medium placing portion on which a medium is placed;

a feed roller rotatably provided in contact with the medium placed on said medium placing portion so as to feed the medium, said feed roller having a drive shaft;

guide members disposed on both sides of said feed roller for guiding the medium being fed, said guide members being movable in a direction substantially perpendicular to a surface of the medium;

a biasing unit that biases said guide members in a direction toward the medium; and roller-shaft-receiving portions that rotatably support said guide members, said roller-shaft-receiving portions being mounted to said drive shaft of said feed roller so as to be movable in said direction substantially perpendicular to the surface of the medium;

said guide members being inclined with respect to the surface of the medium, as said guide members are moved in said direction substantially perpendicular to the surface of the medium.

2. The image forming apparatus according to claim 1, wherein said guide members are disposed substantially coaxially with said feed roller.

3. The image forming apparatus according to claim 1, wherein said guide members include rotatable guide rollers.

4. The image forming apparatus according to claim 1, wherein said guide members are disposed in a symmetrical manner with respect to said feed roller.

5. The image forming apparatus according to claim 1, wherein said guide members include rotatable bodies; and wherein said rotatable bodies are rotatably supported in a state where said guide members are biased by said biasing unit.

6. The image forming apparatus according to claim 5, wherein said rotatable bodies are rotated by movement of the medium fed by said feed roller.

7. An image forming apparatus comprising:

a medium placing portion on which a medium is placed;

a feed roller rotatably provided in contact with the medium placed on said medium placing portion so as to feed the medium;

guide members disposed on both sides of said feed roller for guiding the medium being fed, said guide members being movable in a direction substantially perpendicular to a surface of the medium;

a biasing unit that biases said guide members in a direction toward the medium; and roller-shaft-receiving portions that support said guide members, wherein said roller-shaft-receiving portions are mounted to a drive shaft of said feed roller so as to be movable in said direction substantially perpendicular to the surface of the medium;

each of said roller-shaft-receiving portions including:

a main body having a through hole through which said drive shaft penetrates, and a bearing portion that rotatably supports said guide member; and said through hole being elongated in said direction substantially perpendicular to the surface of the medium.

8. The image forming apparatus according to claim 7, wherein said through hole has a diameter which is larger on a far side with respect to said feed roller than on a near side with respect to said feed roller.

9. The image forming apparatus according to claim 7, wherein each of said roller-shaft-receiving portions includes a plurality of said main bodies and a plurality of said bearing portions.

10. An image forming apparatus comprising:

a medium placing portion on which a medium is placed;

a feed roller configured to feed the medium, said feed roller being rotatably provided in contact with the medium placed on said medium placing portion;

guide members for guiding the medium fed by said feed roller, said guiding members being disposed on both sides of said feed roller and being movable in a direction substantially perpendicular to a surface of the medium;

a supporting member that supports said guide members so that said guide members are rotated and moved by said medium fed by said feed roller, said guide members being moved in said direction substantially perpendicular to the surface of the medium, said supporting member regulating a movement of said guide members in a feeding direction of the medium; and a biasing member that biases said guide members in a direction toward the medium;

said guide members being rotated by the medium fed by said feed roller, and being moved by the medium fed by said feed roller in said direction substantially perpendicular to the surface of the medium, wherein:

said supporting member has a hole through which said shaft of said feed roller penetrates; and said hole has an elongated shape so as to allow said guide members to move in said direction substantially perpendicular to the surface of the medium fed by said feed roller.

11. The image forming apparatus according to claim 10, further comprising a separation member provided so as to face said feed roller, wherein said guide members and said separation member do not face each other.

12. The image forming apparatus according to claim 10, wherein said guide members are moved by the medium fed by said feed roller in said direction substantially perpendicular to the surface of the medium.

13. The image forming apparatus according to claim 10, wherein said guide members are disposed substantially coaxially with said feed roller.

14. The image forming apparatus according to claim 10, wherein said guide members are inclined with respect to the surface of the medium, as said guide members are moved in said direction substantially perpendicular to the surface of the medium.

15. The image forming apparatus according to claim 10, wherein said guide members include rotatable guide rollers.

16. The image forming apparatus according to claim 10, wherein said guide members are disposed in a symmetrical manner with respect to said feed roller.

17. The image forming apparatus according to claim 10, wherein:

said guide members include rotation bodies; and said rotation bodies are rotatably supported in a state where said guide members are biased by said biasing unit.

18. The image forming apparatus according to claim 17, wherein said rotation bodies are rotated by movement of the medium fed by said feed roller.

* * * * *